US009601087B2

(12) United States Patent
Suzuki et al.

(10) Patent No.: US 9,601,087 B2
(45) Date of Patent: Mar. 21, 2017

(54) DISPLAY CONTROL APPARATUS, DISPLAY CONTROL METHOD, AND PROGRAM FOR CONTROLLING THE DISPLAY OF IMAGES IN A STACKED CONFIGURATION

(75) Inventors: Satoshi Suzuki, Minato-ku (JP); Shinichirou Tobinaga, Minato-ku (JP)

(73) Assignees: SONY CORPORATION, Tokyo (JP); SONY INTERACTIVE ENTERTAINMENT INC., Tokyo (JP)

( * ) Notice: Subject to any disclaimer, the term of this patent is extended or adjusted under 35 U.S.C. 154(b) by 199 days.

(21) Appl. No.: 13/310,089

(22) Filed: Dec. 2, 2011

(65) Prior Publication Data

US 2012/0169773 A1 Jul. 5, 2012

(30) Foreign Application Priority Data

Jan. 5, 2011 (JP) ..... 2011-000836

(51) Int. Cl.
*G09G 5/14* (2006.01)

(52) U.S. Cl.
CPC ..... *G09G 5/14* (2013.01); *G09G 2340/0407* (2013.01); *G09G 2340/12* (2013.01); *G09G 2354/00* (2013.01)

(58) Field of Classification Search
CPC ..... G06T 13/00; G06T 2207/20144; G06T 2213/12; G06T 2200/24; G06T 13/20; G06T 2213/08
USPC ..... 348/333.05
See application file for complete search history.

(56) References Cited

U.S. PATENT DOCUMENTS

| | | | | |
|---|---|---|---|---|
| 6,097,389 | A * | 8/2000 | Morris | G06F 3/0483 715/804 |
| 2002/0033848 | A1* | 3/2002 | Sciammarella | G06F 3/0481 715/838 |
| 2009/0158222 | A1* | 6/2009 | Kerr et al. | 715/867 |
| 2009/0278916 | A1* | 11/2009 | Ito | 348/51 |
| 2010/0107068 | A1* | 4/2010 | Butcher et al. | 715/702 |
| 2010/0115457 | A1* | 5/2010 | Bombolowsky | G06F 3/0481 715/782 |
| 2010/0201692 | A1* | 8/2010 | Niles et al. | 345/473 |

FOREIGN PATENT DOCUMENTS

| | | |
|---|---|---|
| CN | 1922652 A | 2/2007 |
| JP | 10-320167 | 12/1998 |
| JP | 11-065802 | 3/1999 |
| JP | 2010-049158 | 3/2010 |

(Continued)

OTHER PUBLICATIONS

Chinese Office Action issued May 6, 2014 in Chinese Application No. 201110449008.2 (with English translation), 20 pages.

(Continued)

*Primary Examiner* — Mark Zimmerman
*Assistant Examiner* — Nurun N Flora
(74) *Attorney, Agent, or Firm* — Oblon, McClelland, Maier & Neustadt, L.L.P.

(57) ABSTRACT

An information processing apparatus that includes a processor that controls a display to display a plurality of images in a stacked configuration, each of the plurality of images corresponding to one of a plurality of groups. The processor assigns movement corresponding to each of the plurality of images based on the respective location of each of the plurality of images in the stacked configuration.

16 Claims, 13 Drawing Sheets

(56) References Cited

FOREIGN PATENT DOCUMENTS

JP 2010-074258 4/2010

OTHER PUBLICATIONS

Japanese Office Action issued Jun. 10, 2014 in Japanese Application No. 2011-000836 (no English translation), 3 pages.
Extended Search Report issued Aug. 27, 2014 in European Patent Application No. 11194471.6.
Japanese Office Action issued Dec. 17, 2014 in Application No. 2011-000836 (no translation), 3 pages.

* cited by examiner

DISPLAY CONTROL APPARATUS, DISPLAY CONTROL METHOD, AND PROGRAM FOR CONTROLLING THE DISPLAY OF IMAGES IN A STACKED CONFIGURATION

CROSS REFERENCE TO RELATED APPLICATIONS

This application claims the benefit of priority under 35 U.S.C. §119 to Japanese Patent Application JP 2011-000836 filed in the Japan Patent Office on Jan. 5, 2011, the entire contents of which is hereby incorporated by reference.

BACKGROUND

The present disclosure relates to a display control apparatus, a display control method, and a program.

Display control apparatuses and software for managing content data such as photographs and video taken by the user have become widespread in recent years. For example, a display control apparatus stores content data, displays a selection screen for the stored content data, and reproduces content data selected by the user in the selection screen.

The selection screen for content data described above includes for example a title list for the content data, and the display control apparatus reproduces content data corresponding to a title selected by the user from such title list. As another example, the selection screen for the content data includes a thumbnail list composed of thumbnails of a plurality of content data items and the display control apparatus reproduces the content data selected by the user from such thumbnail list.

Japanese Laid-Open Patent Publication No. 2010-49158 relates to such a thumbnail list and discloses an image processing apparatus that displays a thumbnail list in which a plurality of thumbnails are disposed so as to be stacked on top of one another.

SUMMARY

However, with the image processing apparatus described above, since thumbnails (representative images) disposed in the background become hidden behind thumbnails disposed in the foreground, there has been the problem that it is difficult to ensure that the thumbnails disposed in the background are visible.

For this reason, the present disclosure aims to provide a novel and improved display control apparatus, display control method, and program that are capable of improving the visibility of representative images to the user.

According to a first exemplary embodiment, the disclosure is directed to an information processing apparatus that includes a processor that controls a display to display a plurality of images in a stacked configuration. The processor assigns movement corresponding to each of the plurality of images based on the respective location of each of the plurality of images in the stacked configuration.

According to another exemplary embodiment, the disclosure is directed to a method performed by an information processing apparatus. The method includes controlling, by a processor of the information processing apparatus, a display to display a plurality of images in a stacked configuration; and assigning, by the processor, movement corresponding to each of the plurality of images based on the respective location of each of the plurality of images in the stacked configuration.

According to another exemplary embodiment, the disclosure is directed to a non-transitory computer-readable medium including computer-program instructions, which when executed by an information processing apparatus, cause the information processing apparatus to perform a method. The method including controlling a display to display a plurality of images in a stacked configuration; and assigning movement corresponding to each of the plurality of images based on the respective location of each of the plurality of images in the stacked configuration.

DETAILED DESCRIPTION OF THE EMBODIMENT(S)

Figure 1:
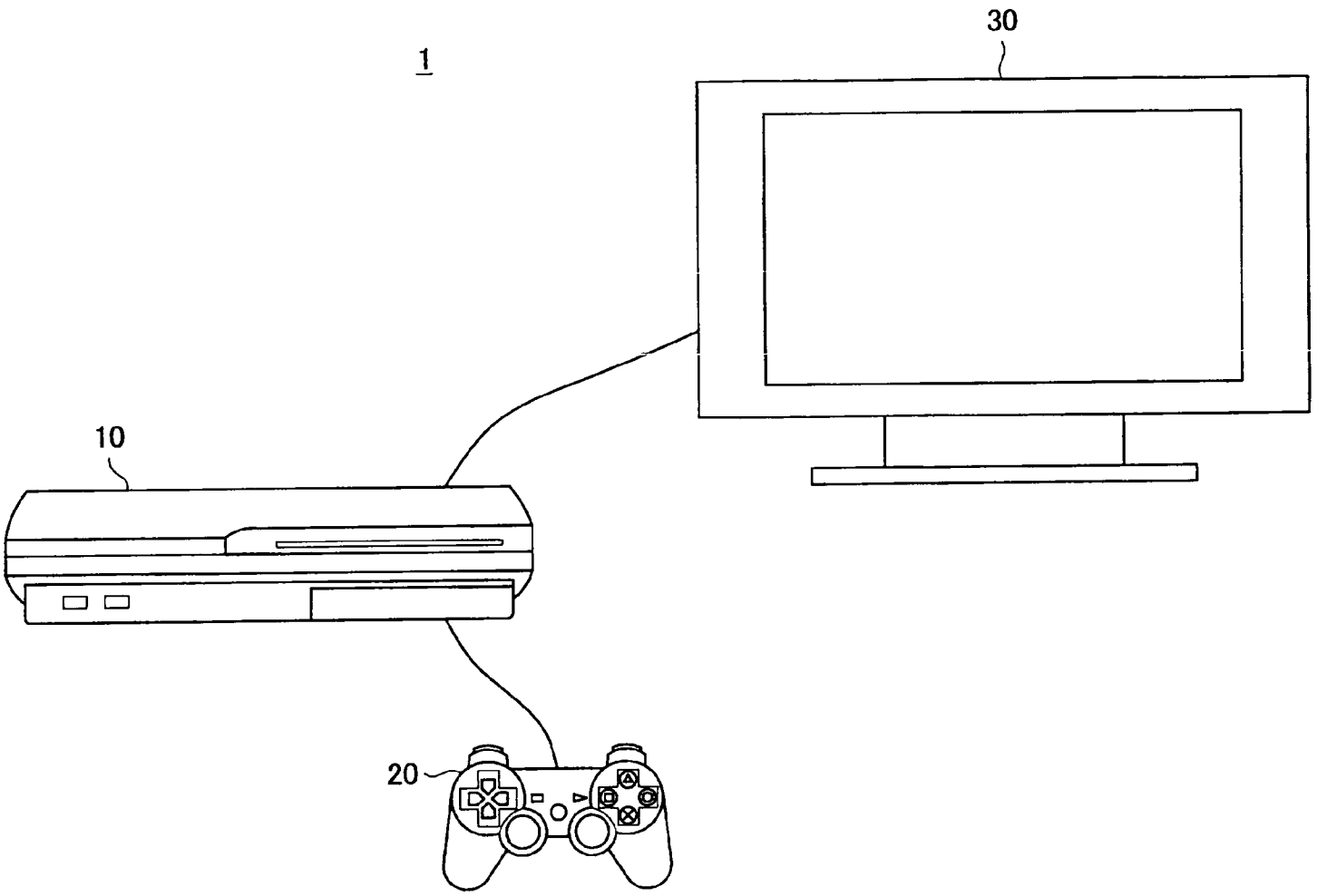
FIG. 1 is a diagram useful in showing the configuration of a display control system according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Also, in this specification and the drawings, in some cases a plurality of structural elements that have substantially the same function and structure are distinguished by different letters that have been appended to the same reference numerals. However, when it is not especially necessary to distinguish between such plurality of structural elements with effectively the same function and structure, only the same reference numerals are used.

An embodiment of the present disclosure will be described in the order of the headings given below.

1. Configuration of Display Control System
2. Event Unit Display Screen
3. Date Unit Display Screen
4. Time Unit Display Screen
5. Transition from Date Unit Display Screen to Time Unit Display Screen
6. Operation of Display Control Apparatus
7. Conclusion

1. Configuration of Display Control System

First, the configuration of a display control system 1 according to an embodiment of the present disclosure will be described with reference to FIG. 1 and FIG. 2.

FIG. 1 is a diagram useful in explaining the configuration of the display control system 1 according to an embodiment of the present disclosure. As shown in FIG. 1, a display control system 1 according to the present embodiment includes a display control apparatus 10, an operation appliance 20, and a display apparatus 30.

The operation appliance 20 is a structure that is operated by the user to indicate operations of the display control apparatus 10. When the operation appliance 20 is operated by the user, an operation signal in accordance with the operation content performed by the user is transmitted to the display control apparatus 10.

Although a controller of a game console is shown in FIG. 1 as one example of the operation appliance 20, the operation appliance 20 may be an input device such as a mouse, a keyboard, a touch panel, one or more buttons, a microphone, and/or one or more switches and/or levers. Also, although an example where the operation appliance 20 is connected to the display control apparatus 10 by a wire is shown in FIG. 1, the operation appliance 20 may be wirelessly connected to the display control apparatus 10. In addition, although an example where the operation appliance 20 is provided separately to the display control apparatus 10 is shown in FIG. 1, the functions of the operation appliance 20 may be incorporated in the display control apparatus 10.

The display apparatus 30 displays a display screen generated and supplied by the display control apparatus 10. As examples, the display apparatus 30 may be a CRT (Cathode Ray Tube) display apparatus, a liquid crystal display (LCD) apparatus, or an OLED (Organic Light Emitting Diode) apparatus. Note that although an example where the display apparatus 30 is provided separately to the display control apparatus 10 is shown in FIG. 1, the functions of the display apparatus 30 may be incorporated in the display control apparatus 10.

The display control apparatus 10 generates a display screen in accordance with an operation signal inputted from the operation appliance 20 and supplies the generated display screen to the display apparatus 30. Although a game console is shown in FIG. 1 as one example of the display control apparatus 10 described above, the display control apparatus 10 may be an information processing apparatus such as a PC (Personal Computer), a home video processing apparatus (a DVD recorder, video player, or the like), a PDA (Personal Digital Assistant), a domestic appliance, a mobile telephone, a mobile video processing apparatus, or a mobile game console.

Figure 2:
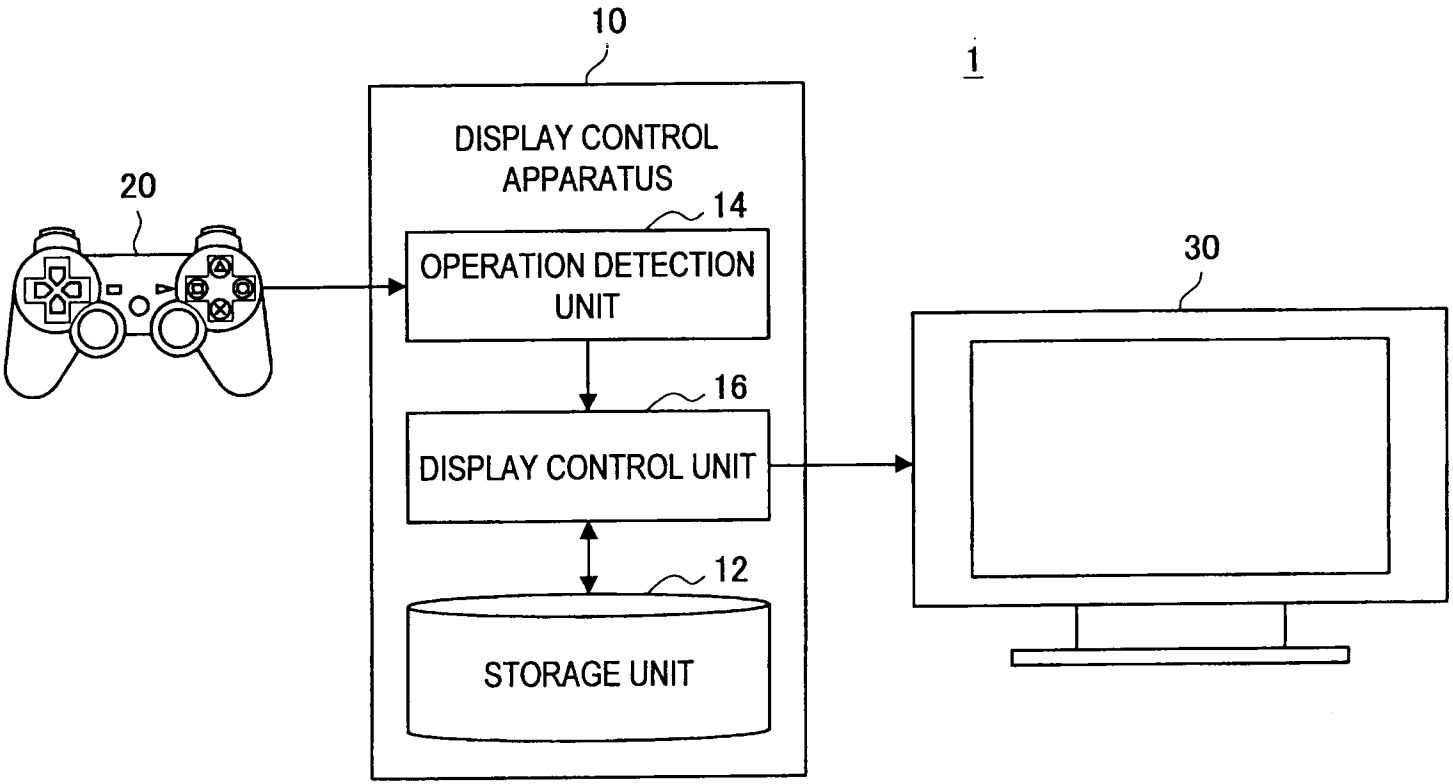
FIG. 2 is a diagram useful in explaining the configuration of a display control apparatus according to an embodiment of the present disclosure.

Also, as shown in FIG. 2, the display control apparatus 10 according to the present embodiment includes a storage unit 12, an operation detection unit 14, and a display control unit 16.

The storage unit 12 stores content data, thumbnails (representative images), and content information (such as a title and acquisition date/time) relating to a plurality of content items. The plurality of content items are grouped according to an existing clustering technique. For example, a clustering technique whereby one group is formed of content items whose acquisition date/times are close may be used.

Note that although an example where the content data is video data taken by the user is mainly explained in this specification, the content data may be still images, may be audio data such as music, a speech, or a radio program, and may be games, software, or the like. Also, the thumbnails may be representative images of the content items in accordance with the actual content of the content items, such as still images and video that form part of the content data.

The storage unit 12 that stores such various data may be a storage medium, such as a nonvolatile memory, a magnetic disk, an optical disc, or an MO (Magneto Optical) disc. EEPROM (Electrically Erasable Programmable Read-Only Memory) and EPROM (Erasable Programmable ROM) can be given as examples of a nonvolatile memory. A hard disk drive, a disc-like magnetic disc, and the like can be given as examples of a magnetic disk. A CD (Compact Disc), a DVD-R (Digital Versatile Disc Recordable), a BD (BluRay Disc (Registered Trademark), and the like can be given as examples of an optical disc. Note that the storage unit 12 may also store a program for causing the display control apparatus 10 to operate in accordance with the present embodiment of the disclosure.

The operation detection unit 14 detects the operation signal inputted from the operation appliance 20. A display mode switching operation, a change operation for a selected item, and a reproduction start operation, all of which are described later, can be given as examples of the content shown by the operation signal.

The display control unit 16 generates an event unit display screen, a date unit display screen, a time unit display screen, and the like. The display control unit 16 switches the display screen between the event unit display screen, the date unit display screen, and the time unit display screen in accordance with display mode switching operations performed by the user. The event unit display screen, the date unit display screen, and the time unit display screen according to the present embodiment of the disclosure will now be separately described in detail with reference to the drawings.

2. Event Unit Display Screen

The event unit display screen is a selection screen for content data that has been grouped according to individual events. A specific example of the event unit display screen will now be described with reference to FIG. 3. Note that in the various drawings that accompany this specification, the display content of the thumbnails has been partially omitted to make the drawings clearer.

Figure 3:
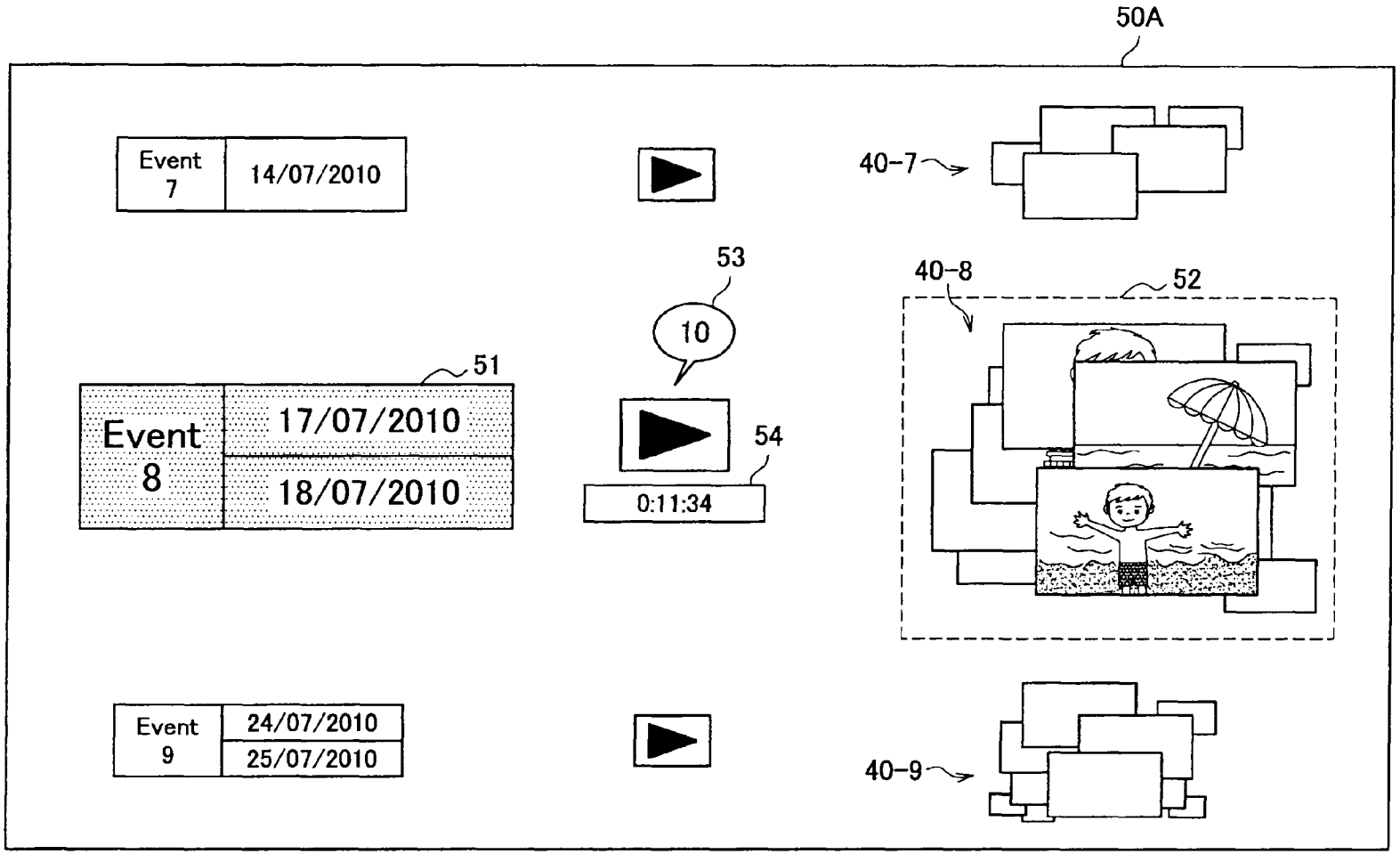
FIG. 3 is a diagram useful in explaining a specific example of an event unit display screen.

FIG. 3 is a diagram useful in explaining a specific example of an event unit display screen 50A. As shown in FIG. 3, the event unit display screen 50A includes an event item display 51, a thumbnail display region 52, a content item number display 53, a reproduction time display 54, and thumbnail groups 40-7 to 40-9.

The event item display 51 is an item display for identifying an event on display. As shown in FIG. 3, when content is sorted in event units according to the date, the event item display 51 includes an event number and acquisition date/times (recording date/times) for content items sorted for this event.

The thumbnail display region 52 is a group display region for displaying a thumbnail group (image group) made up of thumbnails of content sorted into the selected event. In the example shown in FIG. 3, since event 8 is currently selected, the thumbnail group 40-8 of content sorted into event 8 is displayed in the thumbnail display region 52.

The content item number display 53 shows the number of content items sorted into the currently selected event and the reproduction time display 54 shows the total reproduction time for the content sorted into the currently selected event.

As shown in FIG. 3, the display control unit 16 according to the present embodiment of the disclosure disposes the thumbnails that compose the thumbnail group 40 on top of one another (i.e., stacked). Also, in the example shown in FIG. 3, the display size of each thumbnail is larger the closer the position of the thumbnail in the stacking direction to the foreground and smaller the closer the position of the thumbnail in the stacking direction to the background. However, the relationship between the display size and the position in the stacking direction is not limited to this, and conversely the display size of a thumbnail may be smaller the closer the position of the thumbnail in the stacking direction to the foreground and larger the closer the position of the thumbnail in the stacking direction to the background.

Also, although there are no particular limitations on the positions in the stacking direction of the respective thumbnails that compose the thumbnail group 40, as one example the display control unit 16 may dispose the thumbnails so that the older the acquisition date/time of the content, the closer the thumbnail to the foreground.

In this way, in the event unit display screen 50, the thumbnails that compose the thumbnail group 40 are disposed on top of one another. In addition, to improve the visibility of the respective thumbnails, the display control unit 16 according to the present embodiment of the disclosure changes the display positions of the respective thumbnails by assigning movement to each thumbnail that composes the thumbnail group 40. A specific example of such display control will now be described with reference to FIG. 4.

Figure 4:
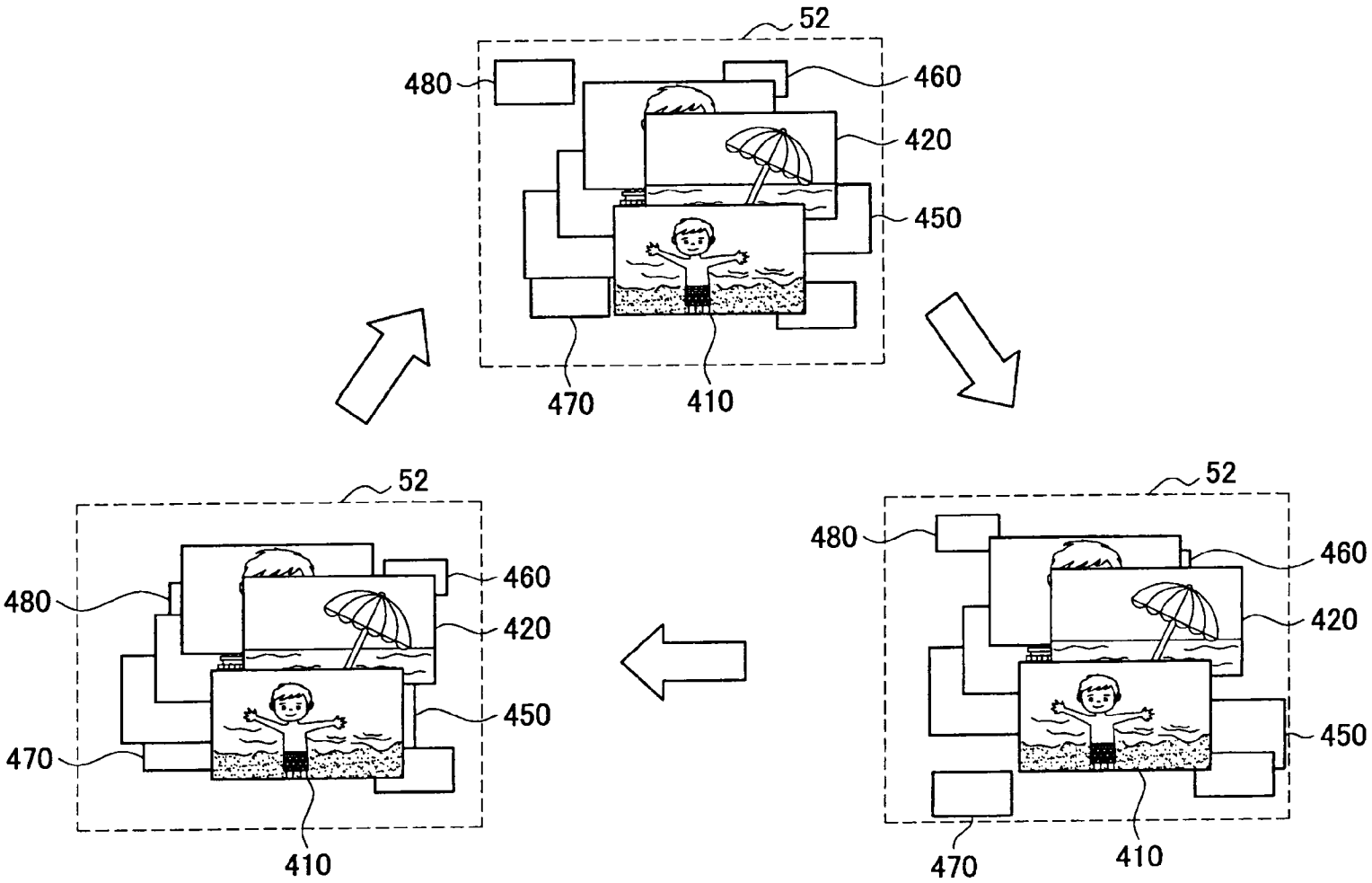
FIG. 4 is a diagram useful in explaining movement of thumbnails in the event unit display screen.

FIG. 4 is a diagram useful in explaining movement of the respective thumbnails in the event unit display screen 50. As shown in FIG. 4, the display control unit 16 changes the display positions of the respective thumbnails in the event unit display screen. More specifically, the display control unit 16 assigns movement to the individual thumbnails so that the closer the position in the stacking direction to the background, the larger the movement. This means that as shown in FIG. 4 for example, compared to the thumbnails 410 and 420 disposed in the foreground, the display positions of the thumbnails 450, 460, 470, and 480 disposed in the background greatly change.

Although thumbnails disposed in the background tend to get hidden behind thumbnails disposed in the foreground, by carrying out the display control described above, it is possible to improve the visibility of the thumbnails disposed in the background. Note that there is no need to assign a different movement to every thumbnail. For example, the thumbnails that compose the thumbnail group 40 may be sorted into two or more layers in accordance with their positions in the stacking direction (i.e., the stacking order), and the display control unit 16 may assign the same movement to the thumbnails that compose the same layer.

Movement of the Thumbnail Group 40 when Selected Event Changes

Figure 5:
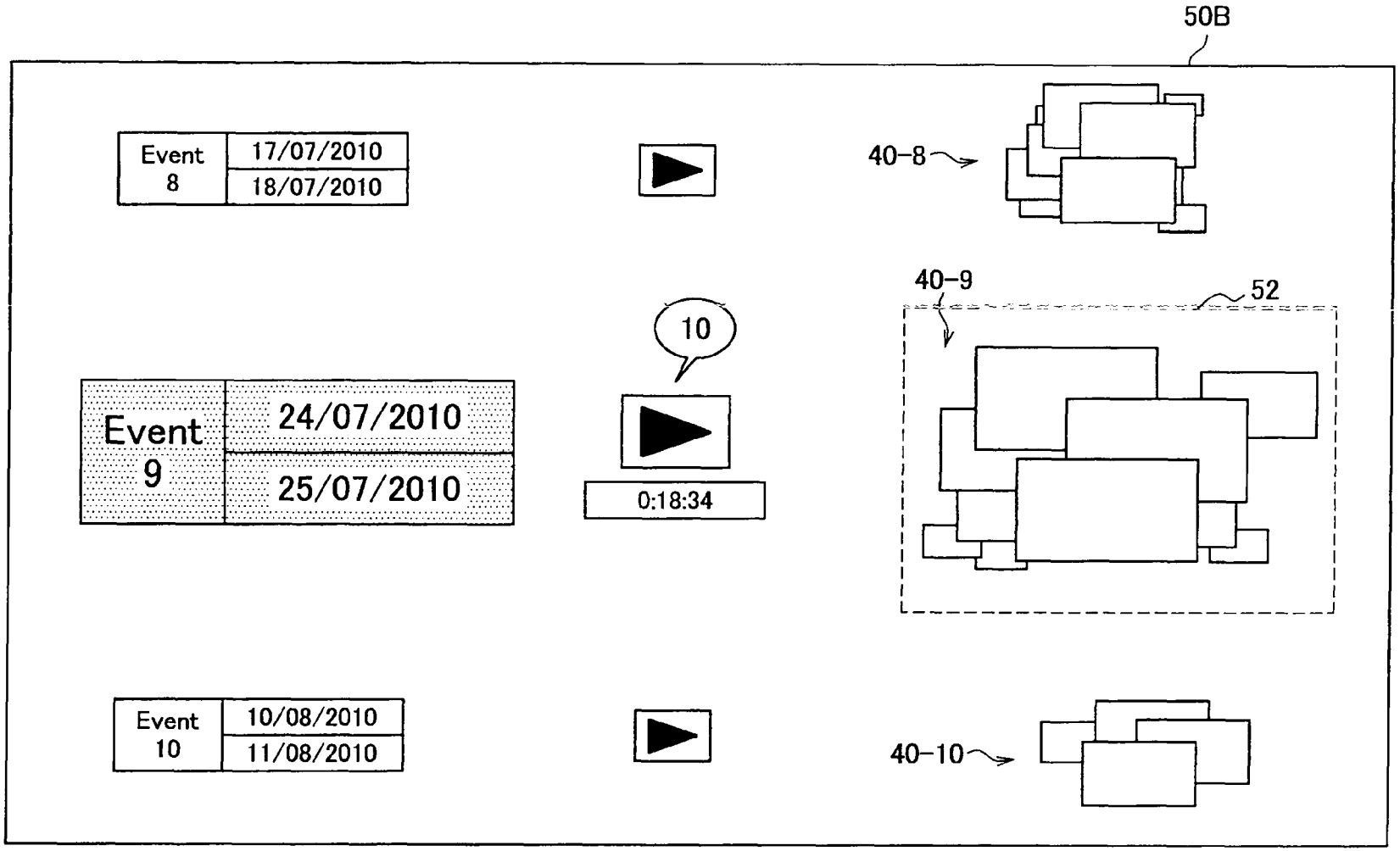
FIG. 5 is a diagram useful in explaining a specific example of an event unit display screen.

The user can also perform a change operation for the selected event in the event unit display screen 50 described earlier. In response to the change operation for the selected event, the display control unit 16 moves displays relating to the newly selected event (i.e., the event item display 51 and the thumbnail group 40) to the center. For example, in a case where event 8 is selected in the event unit display screen 50A as shown in FIG. 3, if the user performs a change operation for the selected event in the downward direction, as shown in FIG. 5 the display control unit 16 moves displays relating to event 9 to the center.

Here, when moving a new thumbnail group 40-9 to the thumbnail display region 52, the display control unit 16 carries out display control to improve the visibility of the respective thumbnails that compose the thumbnail group 40-9. Such display control will now be described with reference to FIGS. 6 and 7.

Figure 6:
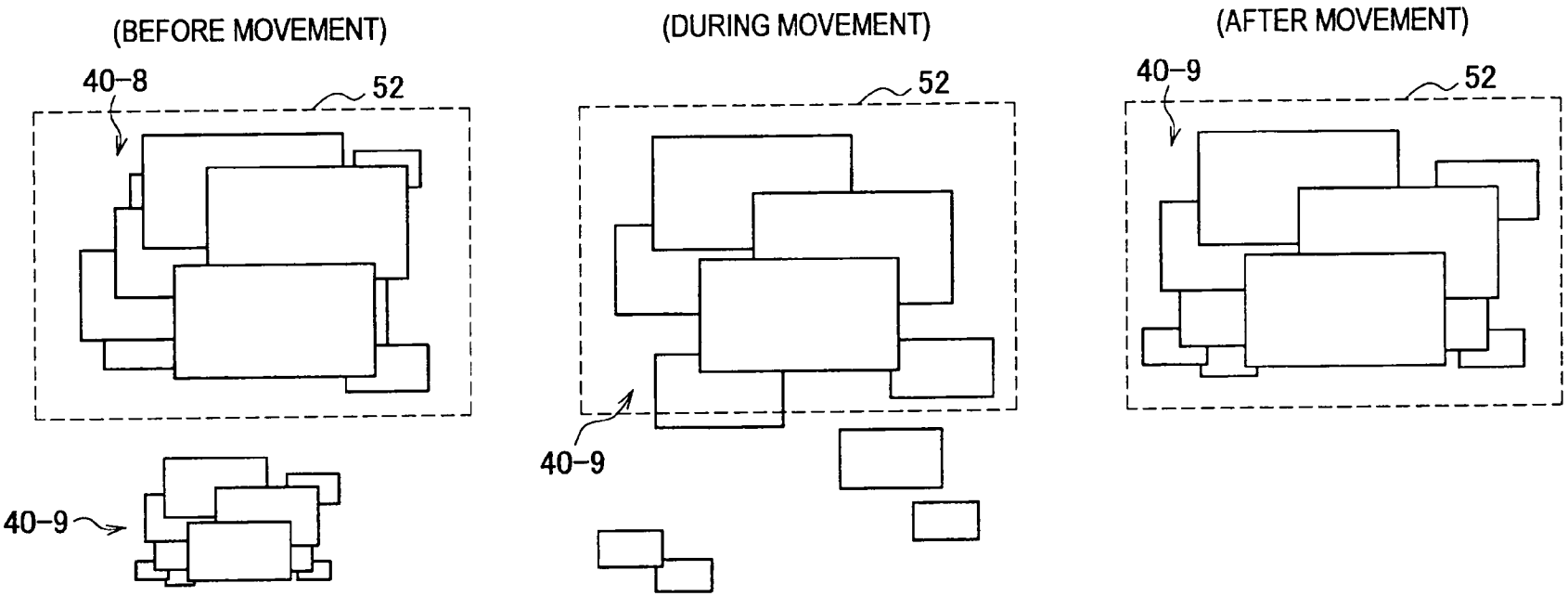
FIG. 6 is a diagram useful in explaining how a newly selected thumbnail group moves to a thumbnail display region.

FIG. 6 is a diagram showing how the thumbnail group 40-9 that has been newly selected is moved to the thumbnail display region 52. As shown in FIG. 6, when moving the thumbnail group 40-9, the display control unit 16 assigns different movement delays to the respective thumbnails that compose the thumbnail group 40-9.

For example, as shown in FIG. 6, the display control unit 16 assigns movement delays so that the closer the position in the stacking direction of a thumbnail to the background, the longer the movement delay. The display control unit 16 may alternatively assign movement delays so that the closer the disposed position of a thumbnail to an opposite side to the direction of movement toward the thumbnail display region 52 (in the example in FIG. 6, since the direction of movement is upward, the closer the thumbnail to the bottom) the longer the movement delay.

According to this configuration, it is possible to improve the visibility of the respective thumbnails that compose a new thumbnail group 40 even when the new thumbnail group 40 is being moved to the thumbnail display region 52.

Note that although an example has been described above where the display control unit 16 assigns movement delays so that the closer the position in the stacking direction of a thumbnail to the background, the longer the movement delay, the display control unit 16 may alternatively assign the movement delays so that the closer the position in the stacking direction of a thumbnail to the foreground, the longer the movement delay. In this case also, it is possible to improve the visibility of the respective thumbnails in the same way.

Figure 7:
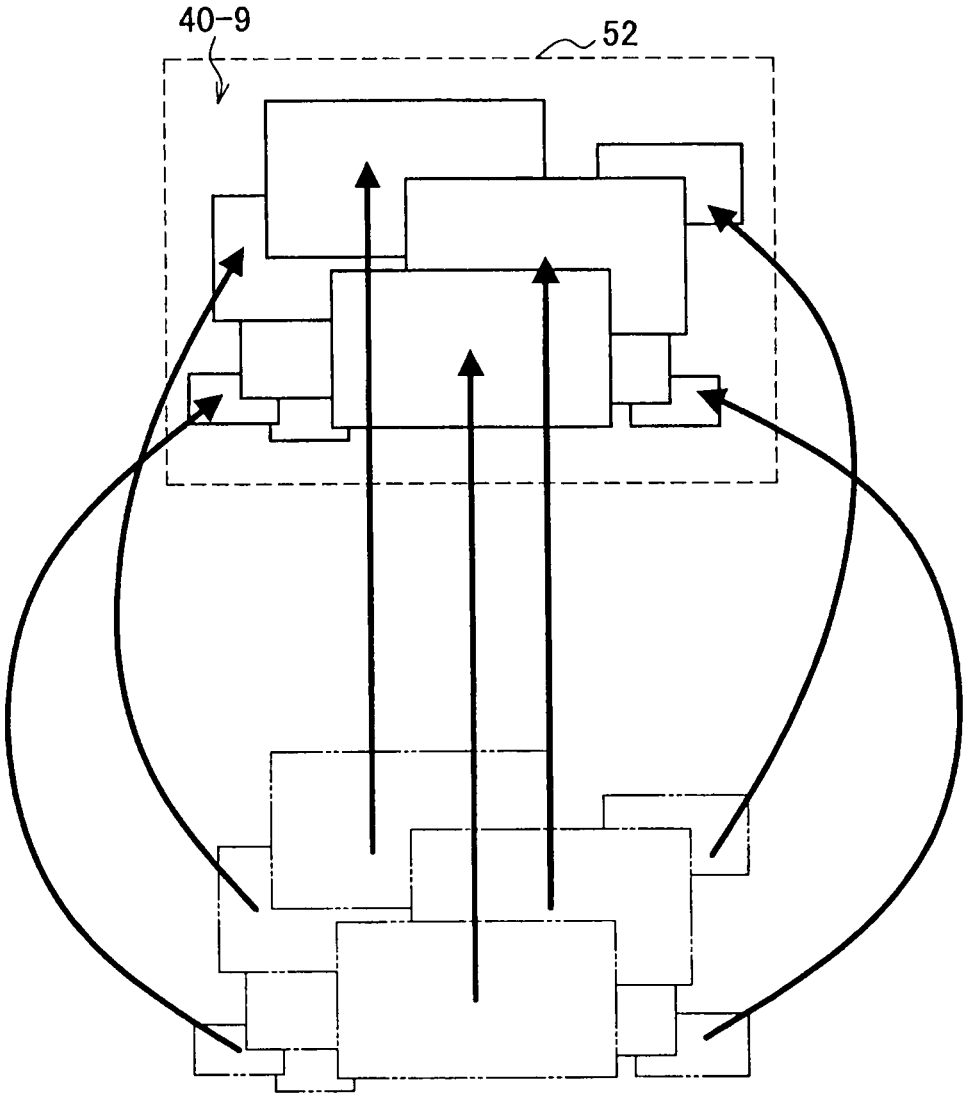
FIG. 7 is a diagram useful in explaining paths of respective thumbnails during movement.

In addition, when moving the thumbnail group 40-9, the display control unit 16 may carry out display control so that the respective thumbnails that compose the thumbnail group 40-9 trace different paths. For example, as shown in FIG. 7, the display control unit 16 may move the thumbnails disposed closest to the foreground so as to trace straight lines and move other thumbnails so that the closer a thumbnail is disposed to the background, the more curved the path traced by the thumbnail. According to such configuration, it is possible to significantly improve the visibility of the respective thumbnails during movement of the thumbnail group 40.

When a change operation for the display mode is performed by the user in the event unit display screen 50 described above, the display control unit 16 generates the date unit display screen described below and has the date unit display screen displayed on the display apparatus 30.

3. Date Unit Display Screen

The date unit display screen is a screen in which thumbnails of content data are sorted based on the acquisition dates of the content data. In this date unit display screen, it is possible for the user to select desired content data.

Figure 8:
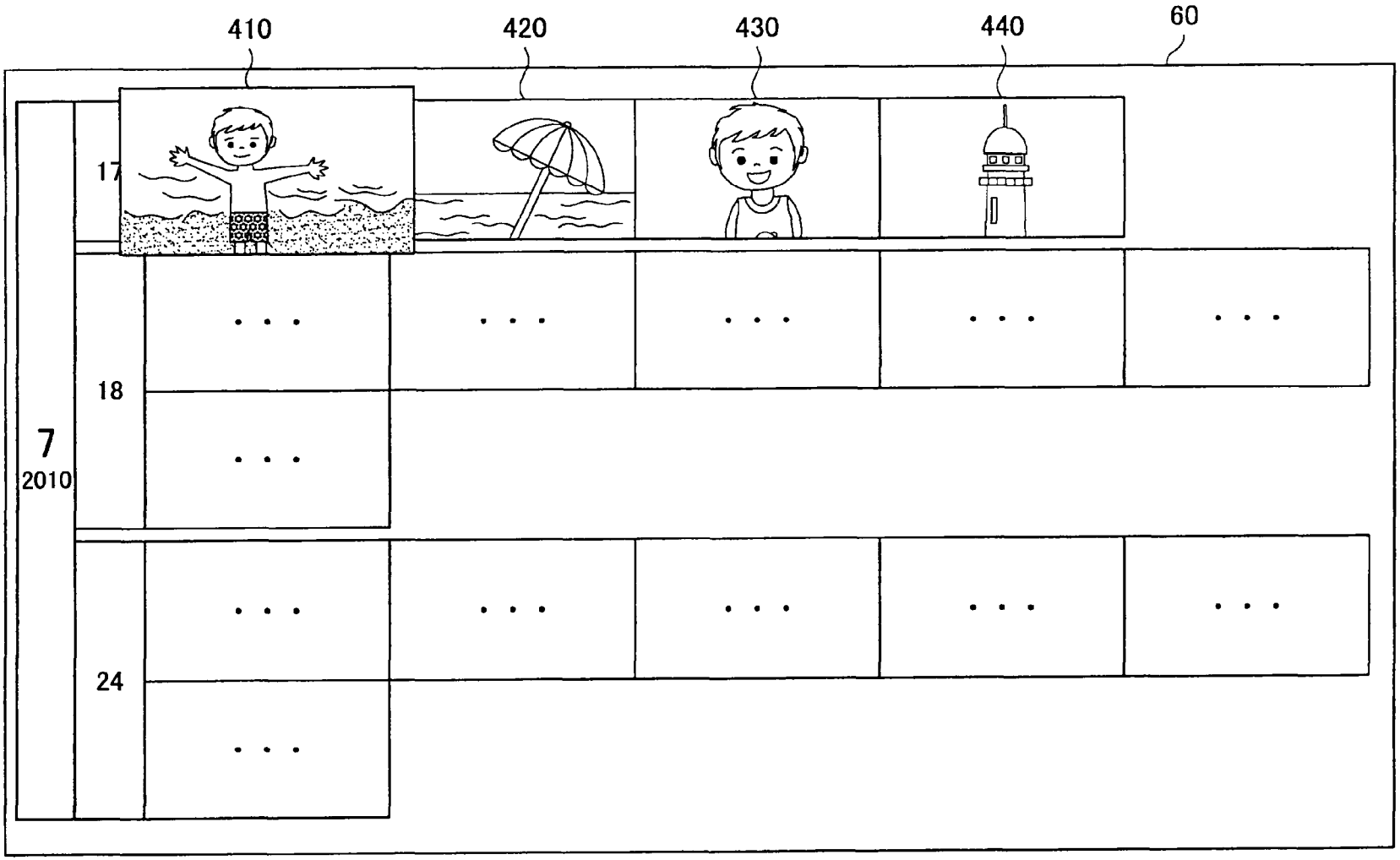
FIG. 8 is a diagram useful in explaining a specific example of a date unit display screen.

FIG. 8 is a diagram useful in explaining a specific example of a date unit display screen 60. As shown in FIG. 8, in the date unit display screen 60, dates are disposed in the vertical direction and thumbnails of content data acquired on such dates are disposed in the horizontal direction alongside the respective dates. For example, thumbnails 410, 420, 430, and 440 of content data whose acquisition date is "Jul. 17, 2010" are disposed in the horizontal direction alongside the date "Jul. 17, 2010".

In the date unit display screen 60, it is possible for the user to operate the operation appliance 20 and place a cursor on a desired thumbnail (content data). Note that the thumbnails displayed in the date unit display screen 60 may be arbitrary still images or video for the corresponding content data, and the display control unit 16 may extract the thumbnails from the content data in keeping with a user operation. For example, if displaying of thumbnails including facial images has been indicated by the user, the display control unit 16 may extract still image parts or video parts including facial images from the content data as thumbnails.

When the user has performed a change operation for the display mode in the date unit display screen 60 described above, the display control unit 16 generates the event unit display screen 50 described earlier or the time unit display screen described below.

4. Time Unit Display Screen

The time unit display screen is a screen in which a plurality of thumbnails for one content data item are sorted based on the acquisition time of the content data. In this time unit display screen also, it is possible for the user to select desired content data.

Figure 9:
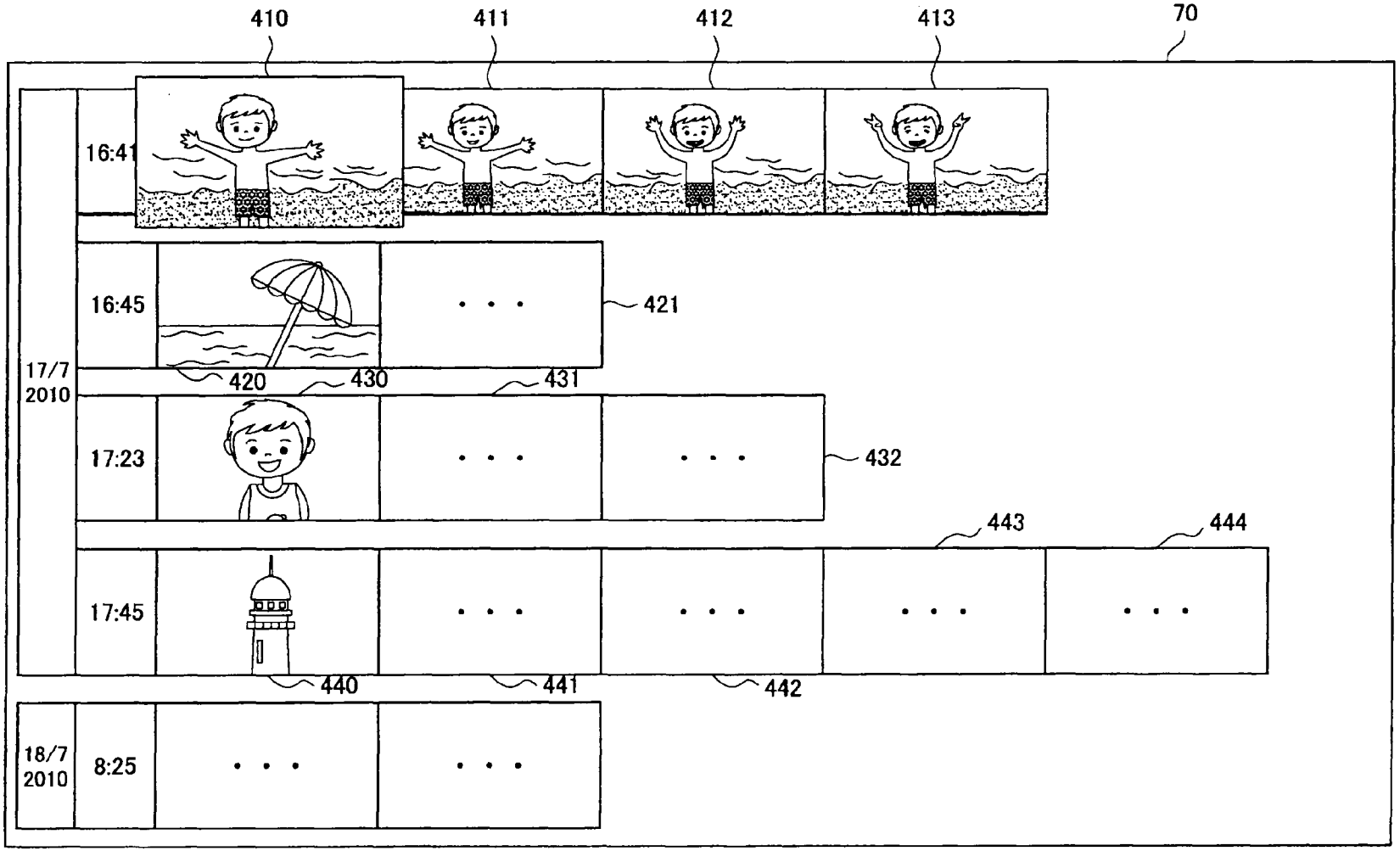
FIG. 9 is a diagram useful in explaining a specific example of a time unit display screen.

FIG. 9 is a diagram useful in explaining a specific example of a time unit display screen 70. As shown in FIG. 9, in the time unit display screen 70, times are disposed in the vertical direction and a plurality of thumbnails of content data acquired at such times are disposed in the horizontal direction alongside the respective times. For example, thumbnails 410, 411, 412, and 413 of content data whose acquisition start time is "16:41, Jul. 17, 2010" are disposed in the horizontal direction alongside the time "16:41, Jul. 17, 2010".

Also, in the time unit display screen 70, the thumbnails 410, 420, 430, and 440 that were disposed in the horizontal direction in the date unit display screen 60 are disposed in the vertical direction. The process that changes the layout in this way is described later in detail under the "5. Transition from Date Unit Display Screen to Time Unit Display Screen" heading.

Here, the number of thumbnails disposed for a content data item may be based on the reproduction time of the content data, for example. That is, the display control unit 16 may dispose a larger number of thumbnails for a content data item with a long reproduction time. For example, since the content data with the acquisition time "17:45, Jul. 17, 2010" has a longer reproduction time than the content data with the acquisition time "16:45, Jul. 17, 2010", many thumbnails (440 to 444) are disposed.

Also, the display control unit 16 may suppress the number of thumbnails disposed for one content data item to a specified maximum number or below. For example, the display control unit 16 may suppress the number of thumbnails disposed for one content data item to five or below so that all of the thumbnails relating to one content data item are visible in the time unit display screen 70 without scrolling.

Also, if displaying of thumbnails including facial images has been indicated by the user, the display control unit 16 may extract and dispose still image parts or video parts including facial images from a content data item as thumbnails. In this case, the display control unit 16 may dispose a number of thumbnails relating to a content data item that exceeds the specified maximum number described above.

If the selection of content data in the time unit display screen 70 or the date unit display screen 60 described above is confirmed by the user, the display control unit 16 starts reproduction for the content data whose selection has been confirmed and has a reproduction screen of the content data displayed on the display apparatus 30. Alternatively, when a selection of an event has been confirmed in the event unit display screen 50, the display control unit 16 reproduces the plurality of content data sorted into the selected event in order.

5. Transition From Date Unit Display Screen to Time Unit Display Screen

A screen transition from the date unit display screen 60 to the time unit display screen 70 described earlier will now be described with reference to FIGS. 8 to 12.

Figure 10:
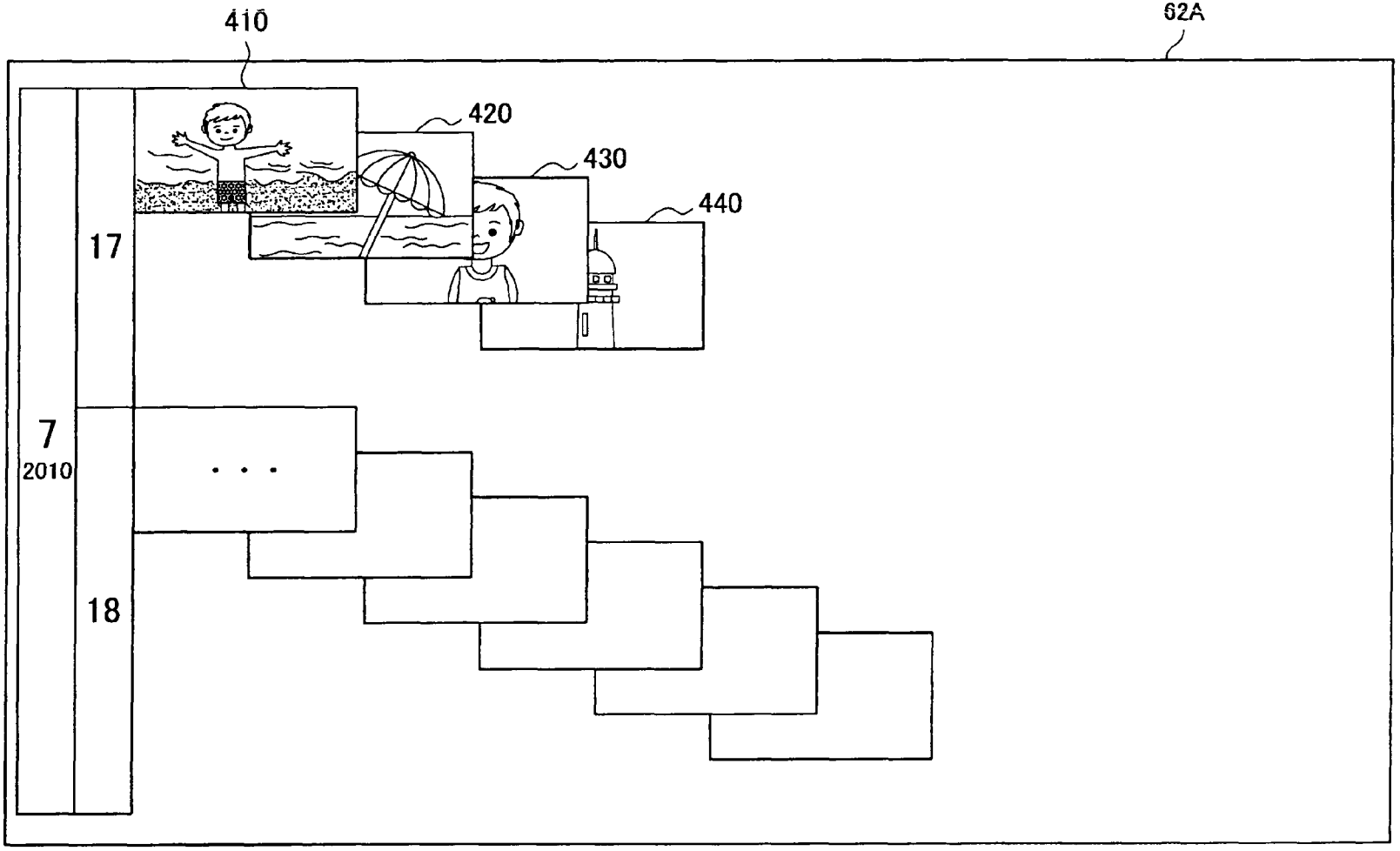
FIG. 10 is a diagram useful in explaining transition screens from the date unit display screen to the time unit display screen.
Figure 11:
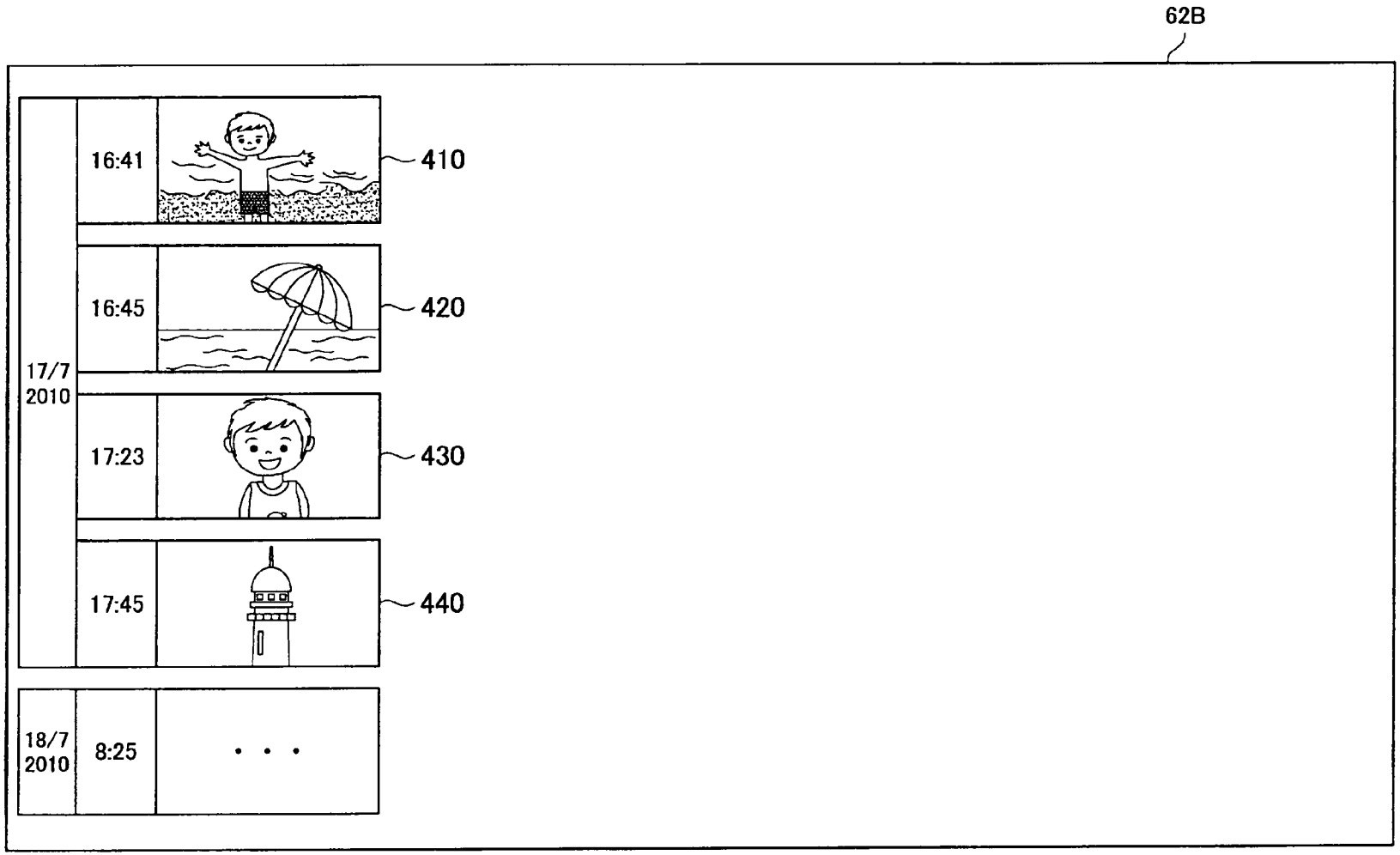
FIG. 11 is a diagram useful in explaining transition screens from the date unit display screen to the time unit display screen.
Figure 12:
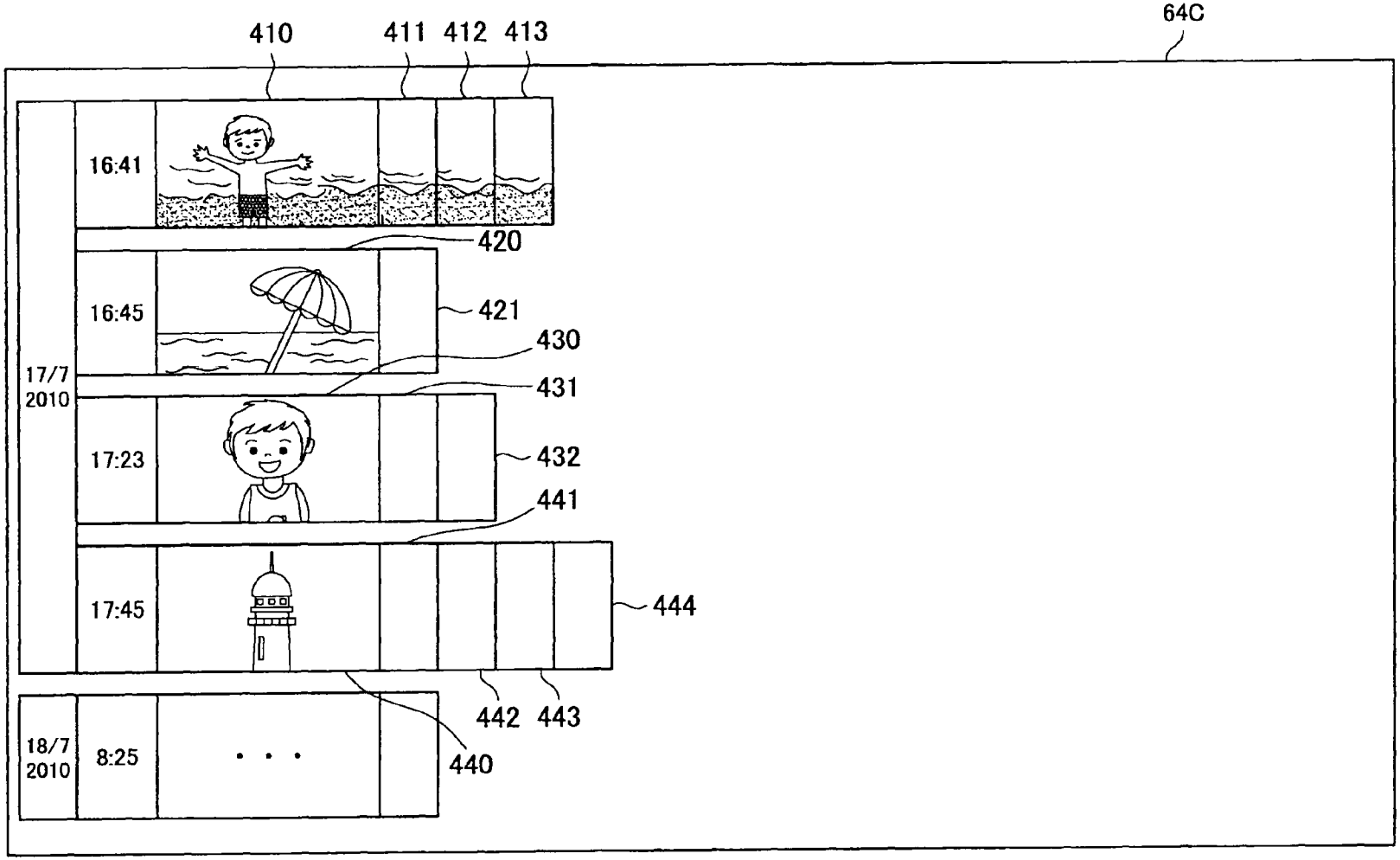
FIG. 12 is a diagram useful in explaining transition screens from the date unit display screen to the time unit display screen.

If a transition to the time unit display screen 70 has been indicated by the user in the date unit display screen 60 shown in FIG. 8, the display control unit 16 generates mid-transition screens 62A, 62B, 62C, etc. shown in FIGS. 10 to 12 and then generates the time unit display screen 70.

More specifically, when a transition to the time unit display screen 70 has been indicated by the user, as shown in FIG. 10, the display control unit 16 rotates the layout direction of the thumbnails (for example 410, 420, 430, and 440) of the content data with the same acquisition date clockwise from the horizontal direction to the vertical direction.

After this, as shown in FIG. 11, when the layout direction of the thumbnails (for example, 410, 420, 430, and 440) of the content data with the same acquisition date has reached the vertical direction, the display control unit 16 displays the acquisition date/times of the respective thumbnails.

In addition, the display control unit 16 spreads out new thumbnails (for example, 411, 412, 413) for content data items from behind the thumbnails (for example, 410) of the respective content data items to finally generate a time unit display screen 70 such as that shown in FIG. 9.

According to this configuration, during a transition between display screens on different levels such as date units and time units, since it is possible to move the display positions of the thumbnails using animation, in the screen after the transition, the user can easily grasp the positions of the respective thumbnails that were present before the transition.

6. Operation of Display Control Apparatus

This completes the description of the configuration and the like of the display control system 1 and the respective display screens according to the present embodiment of the disclosure. Next, the operation of the display control apparatus 10 according to the present embodiment of the disclosure will be summarized in brief with reference to FIG. 13.

Figure 13:
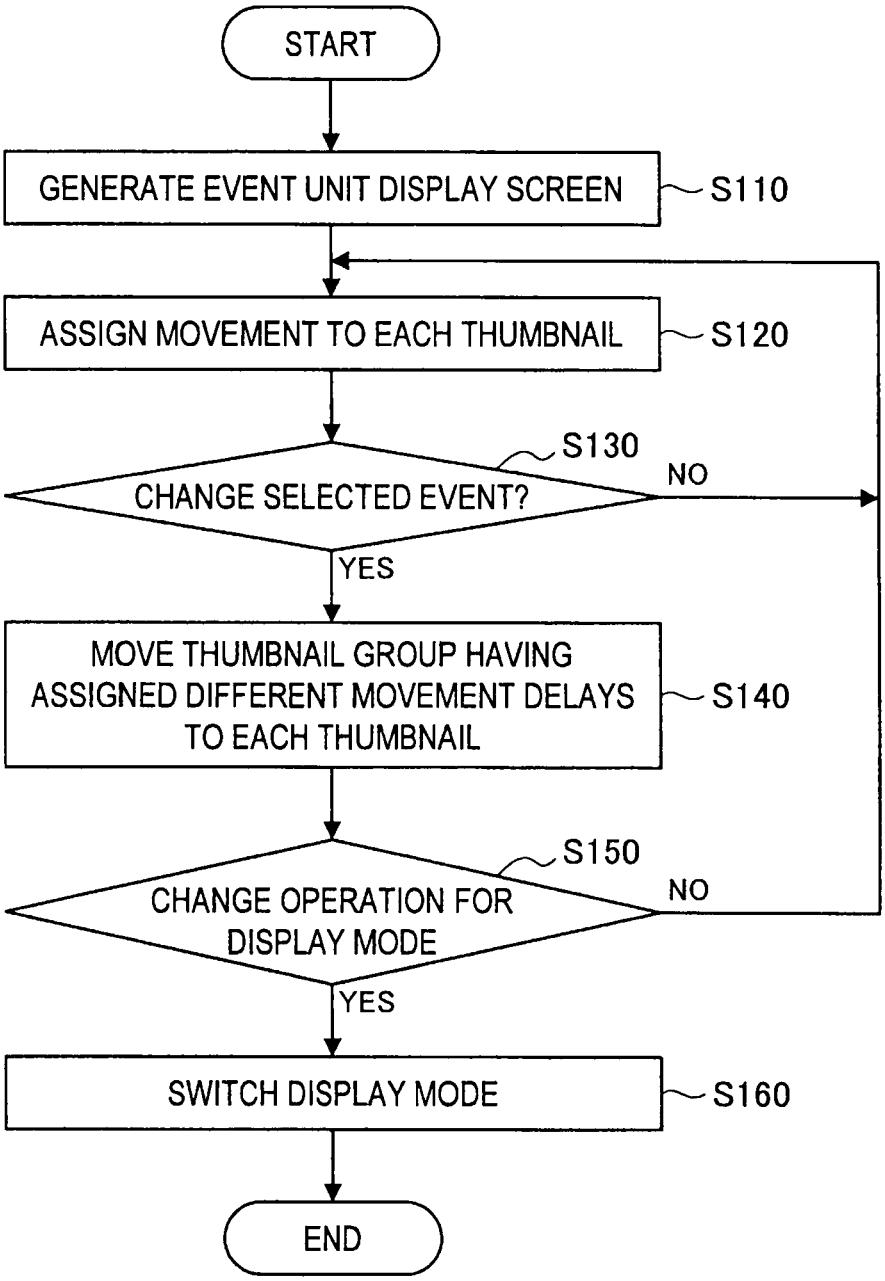
FIG. 13 is a flowchart showing the operation of the display control apparatus according to an embodiment of the disclosure.

FIG. 13 is a flowchart showing the operation of the display control apparatus 10 according to the present embodiment of the disclosure. As shown in FIG. 13, first, after generating the event unit display screen 50 shown in FIG. 3 or the like (S110), the display control apparatus 10 assigns movement to the thumbnails included in the event unit display screen 50 in accordance with the stacked positions of the thumbnails (S120).

After this, if the selected event is changed by the user, the display control apparatus 10 moves the newly selected thumbnail group to the thumbnail display region 52 having assigned movement delays to the thumbnails in accordance with their respective stacked positions (S140).

Also, when a change operation for the display mode has been performed by the user (S150), the display control apparatus 10 switches the event unit display screen 50 to the date unit display screen 60 or the time unit display screen 70 (S160).

7. Conclusion

As described above, according to the present embodiment of the disclosure, by assigning different movements to the respective thumbnails in the event unit display screen 50, the display control unit 16 is capable of improving the visibility of the thumbnails. Also, by assigning different movement delays to the thumbnails that compose the thumbnail group 40 when the thumbnail group 40 is moved, the display control unit 16 is capable of improving the visibility of the respective thumbnails even during movement of the thumbnail group 40.

Also, during a transition between display screens on different levels such as date units and time units, since it is possible for the display control unit 16 according to the present embodiment of the disclosure to move the display positions of thumbnails using animation, in the screen after the transition, the user can easily grasp the positions of the respective thumbnails that were present before the transition.

Although preferred embodiments of the present disclosure have been described in detail with reference to the attached drawings, the present disclosure is not limited to the above examples. It should be understood by those skilled in the art that various modifications, combinations, sub-combinations and alterations may occur depending on design requirements and other factors insofar as they are within the scope of the appended claims or the equivalents thereof.

It is also possible to generate a computer program for causing hardware such as a CPU, ROM, and RAM incorporated in the display control apparatus 10 to realize the same functions as the various structures of the display control apparatus 10 described earlier. A storage medium on which such computer program is stored is provided.

What is claimed is:

1. An information processing apparatus comprising:

a processor that controls a display to display representative images of a plurality of content items in a stacked configuration;

assigns movement to the representative images displayed in accordance with positions of the representative images in a stacking direction of the stacked configuration;

defines a group display region displaying an image group made up of the representative images of some of the plurality of content items;

when a change to the image group displayed in the group display region has been indicated, moves the representative images that compose a new image group to the group display region having assigned delays in accordance with respective positions of the representative images in the stacking direction, and wherein at least some of the representative images are moved over a path that is curved to an extent determined by the respective positions of the representative images in the stacking direction.

2. The information processing apparatus of claim 1, wherein the representative images are thumbnail images.

3. The information processing apparatus of claim 2, further comprising:

a memory that stores a plurality of groups and content corresponding to each of the plurality of groups, wherein the processor generates the thumbnail images based on the stored content corresponding to each of the plurality of groups.

4. The information processing apparatus of claim 1, wherein the stacking direction defines a foreground and a background, and wherein representative images in the foreground are displayed to at least partially overlap representative images displayed in the background.

5. The information processing apparatus of claim 1, wherein the stacking direction defines a foreground and a background, and wherein the processor controls the display to display representative images in the foreground at a first size and representative images in the background at a second size, which is different from the first size.

6. The information processing apparatus of claim 5, wherein the first size is greater than the second size.

7. The information processing apparatus of claim 5, wherein the second size is greater than the first size.

8. The information processing apparatus of claim 1, wherein the stacking direction defines a foreground and a background, and wherein the processor assigns a first amount of movement to representative images displayed in the foreground and a second amount of movement to representative images displayed in the background, the second amount of movement being different from the first amount of movement.

9. The information processing apparatus of claim 8, wherein the second amount of movement is greater than the first amount of movement.

10. The information processing apparatus of claim 1, wherein at least some of the representative images are moved over a first path that is a straight line.

11. The information processing apparatus of claim 1, wherein the processor controls the display to display each of plurality of representative images corresponding to each of a plurality of groups in a list configuration.

12. The information processing apparatus of claim 11, wherein the processor scrolls a plurality of representative images corresponding to each of the plurality of groups in the list.

13. The information processing apparatus of claim 12, further comprising:

an interface that receives an instruction to scroll the plurality of representative images corresponding to each of the plurality of groups in the list.

14. The information processing apparatus of claim 1, wherein the processor controls the display to move the plurality of representative images in a first direction and delay movement of representative images displayed closer to a direction of the first direction by a first amount of time and controls the display to delay movement of representative images displayed closer to a direction opposite the first direction by a second amount of time which is different from the first amount of time.

15. A method performed by an information processing apparatus, the method comprising:

controlling, by a processor of the information processing apparatus, a display to display representative images of a plurality of content items in a stacked configuration;

assigning, by the processor, movement to the representative images displayed in accordance with positions of the representative images in a stacking direction of the stacked configuration;

defining, by the processor, a group display region displaying an image group made up of the representative images of some of the plurality of content items;

when a change to the image group displayed in the group display region has been indicated, moving, by the processor, the representative images that compose a new image group to the group display region having assigned delays in accordance with respective positions of the representative images in the stacking direction, and wherein at least some of the representative images are moved over a path that is curved to an extent determined by the respective positions of the representative images in the stacking direction.

16. A non-transitory computer-readable medium including computer-program instructions, which when executed by an information processing apparatus, cause the information processing apparatus to perform a method comprising:

controlling a display to display representative images of a plurality of content items in a stacked configuration;

assigning movement to the representative images displayed in accordance with positions of the representative images in a stacking direction of the stacked configuration;

defining a group display region displaying an image group made up of the representative images of some of the plurality of content items;

when a change to the image group displayed in the group display region has been indicated, moving the representative images that compose a new image group to the group display region having assigned delays in accordance with respective positions of the representative images in the stacking direction, and wherein at least some of the representative images are moved over a path that is curved to an extent determined by the respective positions of the representative images in the stacking direction.

* * * * *